United States Patent [19]

Suys et al.

[11] 4,282,299

[45] Aug. 4, 1981

[54] PHOTOCONDUCTIVE RECORDING MATERIAL CONTAINING A ZINC OXIDE PARTICLE AND A METALLIC MERCAPTO COMPOUND

[75] Inventors: André R. Suys, Hove; Hendrik H. Sneyers, Wijnegem, both of Belgium

[73] Assignee: Agfa-Gevaert N.V., Mortsel, Belgium

[21] Appl. No.: 940,311

[22] Filed: Sep. 7, 1978

[30] Foreign Application Priority Data

Sep. 13, 1977 [GB] United Kingdom ..... 38164/77

[51] Int. Cl.[3] ..... G03G 5/08

[52] U.S. Cl. ..... 430/89; 430/87

[58] Field of Search ..... 96/1.8, 1.7, 1.5; 430/89, 87

[56] References Cited

U.S. PATENT DOCUMENTS

| | | | |
|---|---|---|---|
| 3,684,509 | 8/1972 | van der Hevvel | 96/1.8 |
| 3,736,134 | 5/1973 | Gosselink et al. | 96/1.8 |
| 4,010,033 | 3/1977 | Metzger | 96/1.7 |

FOREIGN PATENT DOCUMENTS

| | | | |
|---|---|---|---|
| 1151617 | 5/1969 | United Kingdom | 96/1.7 |
| 1215685 | 12/1970 | United Kingdom | 96/1.8 |

*Primary Examiner*—Edward C. Kimlin

*Assistant Examiner*—John L. Goodrow

*Attorney, Agent, or Firm*—William J. Daniel

[57] ABSTRACT

An electrophotographic recording material comprising a photoconductive layer incorporating photoconductive zinc oxide in the presence of a compound within the scope of the following general formula:

R—SH wherein: R represents (1) an unsubstituted aliphatic hydrocarbon group containing at least 5 carbon atoms or (2) an aliphatic hydrocarbon group substituted with a —COOQ group wherein Q is an organometallic group or an aliphatic hydrocarbon group, containing at least 5 carbon atoms, or (3) an aliphatic hydrocarbon group substituted with a —COOH group and containing at least two methylene groups between the —COOH group and the —SH group, and said general formula including the modification wherein the hydrogen atom of the —SH group is substituted to form an organometal mercaptide.

The above compound improves the charge retention of the photoconductive layer, i.e. lowers its dark-decay, under conditions of high relative humidity.

7 Claims, No Drawings

PHOTOCONDUCTIVE RECORDING MATERIAL CONTAINING A ZINC OXIDE PARTICLE AND A METALLIC MERCAPTO COMPOUND

The present invention relates to photoconductive recording materials.

For the production of photoconductive recording materials it is known to use certain inorganic or organic photoconductive compounds. Examples of inorganic photoconductive compounds are sulphur, selenium and oxides, sulphides and selenides of zinc, cadmium, lead, antimony, bismuth and mercury. Examples of organic compounds are anthracene and poly-N-vinylcarbazole. If necessary in order to form a mechanically firm layer, the photoconductive substance is applied in dispersed state in an electrically insulating binder medium. Such layer may be produced by means of coating compositions in which the binders are dissolved in an appropriate evaporatable liquid and the photoconductor substance is dispersed therein.

Depending on the type of photoconductor, binding agent and coating solution these layers take up moisture more or less easily. Humidity is one of the main causes of poor chargeability and rapid dark decay of photoconductive layers.

By "dark decay" is understood the decrease in the duration of the electrostatic charge that has been applied to the photoconductive layer of the recording material while keeping the charged recording material away from electromagnetic radiation that would provoke photoconduction.

It has been established experimentally that humidity is especially detrimental to the chargeability of photoconductive zinc oxide layers and that even the presence of a strongly hydrophobic binder is not a guarantee that sufficient protection against moisture is obtained (see Photogr.Sci.Eng., Vol. 11, 1967, p. 140).

From U.S. Pat. No. 3,197,307 of Norman W. Blake and Cornelia C. Natale issued July 27, 1965 it is known that Lewis Acids improve the sensitivity and dark decay of photoconductive zinc oxide layers. In the British Patent No. 1,020,504 filed Dec. 29, 1961 by Gevaert Photo-Producten N.V. ionic organic phosphorus compounds e.g. acid monobutyl phosphate and in the British Patent No. 1,020,506 filed Dec. 29, 1961 by Gevaert Photo-Producten N.V. acrylic aliphatic acid compounds containing a hydroxyl group as in lactic acid are described as suitable compounds for increasing the dark-resistivity of photoconductive zinc oxide.

According to the present invention an electrophotographic recording material containing a photoconductive layer having a reduced or retarded dark decay under humidity conditions is provided.

The present electrophotographic recording material contains in a photoconductive layer photoconductive zinc oxide particles some or all of which are in contact and/or in reacted form with at least one organic compound within the scope of the following general formula:

R—SH wherein: R represents an (1) unsubstituted aliphatic hydrocarbon group containing at least 5 carbon atoms, or (2) an aliphatic hydrocarbon group, e.g. methyl or ethyl, substituted with a —COOQ group wherein Q is an organometallic group, or an aliphatic hydrocarbon group containing at least 5 carbon atoms or (3) an aliphatic hydrocarbon group substituted with a —COOH group and containing at least two methylene groups between the —COOH and the —SH group, and wherein, according to a preferred modification, the hydrogen atom of the —SH group is substituted to form an organometal mercaptide.

The term "aliphatic hydrocarbon group" includes here straight chain, branched chain as well as ringclosed aliphatic hydrocarbon i.e. a cycloaliphatic group.

Preferred organometallic compounds reducing the "dark decay" of layers containing photoconductive zinc oxide under humidity conditions are dialkyltinmercaptides being within the scope of one of the following general formulae (A), (B) and (C):

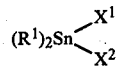

(A)

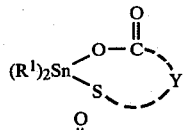

(B)

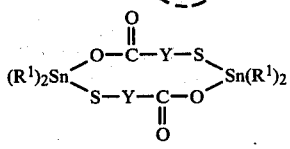

(C)

wherein: $R^1$ represents an alkyl group e.g. a $C_1$–$C_4$ alkyl group, including an aromatically substituted alkyl group such as benzyl or phenethyl, each of $X^1$ and $X^2$, which may be the same or different, represents (1) a

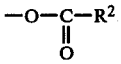

group wherein $R^2$ represents an alkyl group substituted with —SH, or (2) a —S—$R^3$ group wherein $R^3$ represents an alkyl group or a substituted alkyl group e.g. substituted with a carboxyl group or ester group, and Y represents an alkylene group e.g. an ethylene group.

Compounds according to general formula (A) are described in U.S. Pat. Nos. 2,789,102 of Elliott L. Weinberg issued Apr. 16, 1957 and 2,789,104 of Hugh E. Ramsden, Elliott L. Weinberg and Louis A. Tomka issued Apr. 16, 1957.

Compounds according to general formula (B) may be prepared as described in J.Polymer Sci.Part A Vol. 2 (1964) 1802 or according to the method for preparing compound 3 of Table 1 hereinafter.

Compounds according to general formula (C) may be prepared as described in the United Kingdom Patent No. 1,018,111 filed Apr. 24, 1961 by Pure Chemicals Ltd., a British Company of Kirkby Industrial Estate, Kirkby.

Preferred stabilizing compounds within the scope of at least one of the above general formulae are listed in the following Table 1 with their structural formula and reference of preparation.

TABLE 1

| No. | Structural formula | Reference of preparation |
|---|---|---|
| 1 | $HS-(CH_2)_{11}-CH_3$ | D. Fore jr. and R. W. Bost, Am.Soc. |

TABLE 1-continued

| No. | Structural formula | Reference of preparation |
|---|---|---|
| 2 | $HS-(CH_2)_2-COOH$ | 59,2557 (1937) E. Billmann, A.348,120 (1906) |
| 3 | 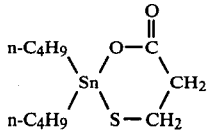 | see hereinafter |
| 4 | 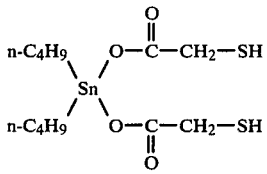 | see hereinafter |

The compounds 3 and 4 are in the group of reaction products obtainable as the reaction product of a dialkyltin oxide with a mercaptan containing a carboxylic acid group.

The preparation of compound 3 proceeded as follows: 0.02 mole of $(n\text{-}C_4H_9)_2SnO$ was dispersed in 125 ml of toluene. Then 0.05 mole of $\beta$-mercaptopropionic acid was slowly added. Whilst stirring the reaction mixture was refluxed for 5 h. Thereupon the water formed in the reaction was removed by azeotropic distillation. The remaining mixture was filtered and concentrated by evaporation of the toluene at reduced pressure. The product was recrystallized from ethanol. Melting point: 148° C.

The preparation of compound 4 proceeded as follows:

Into a 250 ml three-necked flask fitted with a thermometer, stirrer, dropping funnel and Dean and Stark apparatus with reflux cooler were placed 125 ml of toluene which was made anhydrous by azeotropic distillation. Into the dry toluene 5 g (0.02 mole) of $(n\text{-}C_4H_9)_2SnO$ were dispersed. Thereupon 10.2 g (0.11 mole) of thioglycolic acid dissolved in 20 ml of anhydrous toluene were dropwise added. The temperature of the reaction mass rose from 22° to 28° C. The water formed in the reaction was removed by azeotropic distillation and the remaining solution was concentrated by evaporating the toluene. 14 g of a white product were obtained. Purification proceeded by recrystallization from 195 ml of ethanol.

The obtained product was dried under vacuum. Yield; 3 g. Melting point: 182° C.

By infrared spectroscopy a band characteristic for carboxylate link was found.

As compared with previously available materials photoconductive recording materials incorporating photoconductive zinc oxide in admixture with the above defined preferred compounds have a considerably improved charge retention, i.e. much lower dark decay, under conditions of high relative humidity (more than 70%) in a temperature range of 10°-40° C.

Although according to the present invention a better charge retention of the photoconductive recording material is based on the use of compounds according to the above general formula in combination with photoconductive zinc oxide, the photoconductive recording materials of the present invention may contain in addition to the zinc oxide other photoconductive substances. Such substances are e.g. selenium; oxides, sulphides, selenides and sulphoselenides of cadmium, mercury, antimony, bismuth, thallium, molybdenum, aluminium and lead and organic photoconductive substances, e.g. poly-N-vinylcarbazole and those described in the United Kingdom Patent Specification Nos. 1,228,411 filed Jan. 26, 1968, 1,301,657 filed Mar. 24, 1969 and 1,379,387 filed Dec. 11, 1970 all of them by Agfa-Gevaert N.V. Thus, the compounds of the above general formula can be used for the photoconductive recording materials with high sensitivity for visible light formed by a mixture of 95-50 percent by weight of photoconductive zinc oxide and 5-50 percent of photoconductive crystalline mixed cadmium sulphide-selenide as described in the U.S. Pat. No. 3,658,523 of Robert Joseph Noë issued Apr. 25, 1972.

The contacting of the photoconductive zinc oxide with one or more of the above compounds reducing dark decay may take place at any of the stages of the manufacturing process of the recording material. The contacting can take place before, during or after the application of the coating as a layer to a support. In order to achieve an optimum effect, the compound is preferably contacted in dissolved form with the photoconductive zinc oxide. In order to obtain the desired effect it is not necessary for the action of the compound involved to occur over the entirety of the available surface of the grains or clusters of grains of the photoconductor. The desired effect indeed is likewise obtained if the photoconductive layer has been prepared starting from a mixture of untreated photoconductive zinc oxide and substances treated according to the present invention.

The following methods can be applied successfully in performing the contacting of the compound with the photoconductive zinc oxide optionally mixed with other photoconductive substances:

1. The photoconductive zinc oxide is dispersed in an organic solvent wherein the compound reducing dark-decay is soluble, whereupon the desired amount of the compound is added and thoroughly mixed therewith. Then a binding agent is added.
2. The photoconductive zinc oxide, a binding agent and a solvent for the latter are ground, e.g. in a ball mill till the desired particle size of the photoconductor is obtained. One or more of compounds reducing the dark-decay are added before, during or after grinding.
3. The compound reducing dark-decay is added to an aqueous dispersion of the photoconductive zinc oxide and the treated particles are filtered off or centrifuged, dried and then dispersed in a solution of a binding agent. This method is especially suited for compounds with free thiol groups or with mercaptide groups that can react with the zinc ions of the photoconductor.
4. The compound reducing dark-decay is dissolved in a volatile solvent and is incorporated by inbibition into the photoconductive layer. Particularly suitable therefor are photoconductive layers having a porous structure as described, e.g. in the United Kingdom Patent Specification No. 1,199,061 filed Apr. 26, 1967 by Gevaert-Agfa N.V.

The compound(s) reducing dark-decay may be added to a layer or sheet adjacent to the photoconductive layer with the proviso that it (they) can reach the photoconductive zinc oxide, e.g. by diffusion.

Suitable amounts of compound(s) reducing dark-decay are in the range of 0.05 to 5.0% by weight with respect to the photoconductive zinc oxide.

In the manufacture of the photoconductive recording material according to the present invention the photoconductive layer is coated from a composition containing the photoconductive substance(s) in a suitable ratio with respect to a binding agent or mixture of binding agents that in dry state preferably have a resistivity of at least $10^{10}$ Ohm.cm. Thanks to the presence of the compound(s) reducing dark-decay binding agents with a lower resistivity can be used. Such binding agents are described e.g. in the United Kingdom Patent Specification No. 1,020,504 mentioned hereinbefore. Other suitable binding agents have been described in U.K. Patent Specification Nos. 1,199,061 mentioned hereinbefore and 1,266,151 filed Apr. 26, 1968 by Agfa-Gevaert N.V.

The ratios of photoconductive substance, e.g. photoconductive zinc oxide alone, to the binding agent may vary within wide limits. It is preferred to apply the photoconductive substance in amounts of 3 parts to 9 parts by weight to 1 part of binder and in amounts of 5 to 60 grams of photoconductor per square meter of photoconductive layer.

In general the thickness of the photoconductive layer is in the range of 5 to 50 microns.

In the preparation of a recording material according to the invention, an electrically conductive element is preferably used as support for the photoconductive layer. The support may be in the form of a sheet, plate, web, drum or belt. By electrically conductive is understood that said element at the surface contacting the photoconductive layer has a resistivity smaller than that of the photoconductive layer i.e. generally smaller than $10^9$ Ohm.cm.

Suitable conductive plates are metal plates, e.g. plates of aluminium, zinc, iron, copper, or brass.

Suitable conductive sheets are made, e.g. of paper or of polymeric substances with low resistivity, e.g. polyamides. Good results are obtained when using paper sheets comprising hygroscopic and/or antistatic substances as described, e.g., in United Kingdom Patent Specification No. 964,876 filed Feb. 5, 1959 by Gevaert Photo-Producten N.V.

Further suitable supports are insulating sheets provided with a conductive layer, e.g. thin metal foil or polyionic polymer layer as described in the United Kingdom Patent Specification No. 1,208,474 filed Feb. 10, 1971 by Agfa-Gevaert N.V. or CALGON CONDUCTIVE POLYMER 261 (trade mark of Calgon Corporation, Inc., Pittsburgh, Pa., U.S.A.) being a solution containing 39.1% by weight of active recurring units of the following type:

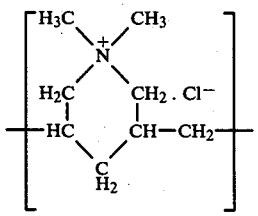

In order to establish the effect of selected compounds on charge retention, that is the dark-resistance of a photoconductive layer under different conditions of humidity, the layer containing such compound is kept under fixed humidity and temperature conditions for a predetermined period of time. Immediately after the period the photoconductive layer is charged, e.g. with a corona device, and the applied charge in terms of voltage with respect to the ground is measured. Thereupon the charge retention, i.e. the voltage remaining, after a certain period of time is measured and expressed in % voltage with respect to the original applied voltage level.

The present electrophotographic recording material may be used in a known electrophotographic process to produce visible images by the steps of electrostatically charging the photoconductive layer in the dark, imagewise exposing said layer in order to discharge the irradiated areas thus forming a latent electrostatic image, which is developed by electrostatically attractable particles known as toner material.

The present invention is illustrated by the following Examples. All parts, ratios and percentages are by weight unless otherwise stated.

EXAMPLE 1

A photoconductive test material was prepared as follows. The following mixture was dispersed in a ball-mill for 24 h:

- 18 g of DE SOTO E 202 (trade name of De Soto Inc., Des Plaines, Ill., U.S.A.) for a 54% solution in a 50/50 by volume mixture of butylacetate and toluene of a terpolymer of vinyl acetate/ethyl acrylate/styrene (44/32/24),
- 72 ml of 1,2-dichloroethane,
- 14 ml of n-butyl acetate,
- 60 g of photoconductive zinc oxide MICROX (trade name of Durham Chemicals Ltd., England),
- $0.37\times10^{-2}$ mole per mole of zinc oxide of a compound as defined hereinafter and selected for determining its influence on the dark-decay.

The blank or control material did not include such a compound and is called material I. The comparison materials II to VIII contained respectively acid monobutyl phosphate; tetrachlorophthalic anhydride; tin stearate; zinc stearate; stearic acid; dibutyltin oxide and mercaptoacetic acid (the latter compound being known from U.S. Pat. No. 3,197,307 mentioned hereinbefore for use in photoconductive zinc oxide layers). Materials IX and X contained compounds as defined in the present invention i.e. β-mercaptopropionic acid and the organo-tin compound No. 3 of Table 1.

The coating compositions of materials I to X were doctor blade-coated to an aluminium foil in the same ratio, viz. 30 g per sq.m.

After drying parts of the materials were conditioned for 24 h at 20° C. in an atmosphere of a relative humidity (R.H.) of 50% and other parts at a relative humidity of 85%. Thereupon the materials were charged with a negative corona (having a voltage on the corona wires of −6000 V with respect to the ground) for 30 s. Immediately after the corona charging was terminated the charge applied to each material was measured by recording with an electrometer the voltage built up between the recording layer surface and the ground. Then the voltage remaining after 30 s and 120 s respectively was noticed and expressed in the following Table 2 in terms of percentage of the initial voltage.

TABLE 2

| Material | Relative Humidity % R.H. | Charge acceptance expressed in voltage (V) | Charge retention expressed in % with respect to initial voltage (V) after 30 s | after 120 s |
|---|---|---|---|---|
| I | 50 | 650 | 72 | 45 |
| | 85 | 490 | 29 | 11 |
| II | 50 | 600 | 80 | 53 |
| | 85 | 580 | 78 | 52 |
| III | 50 | 610 | 33 | 8 |
| | 85 | 570 | 46 | 16 |
| IV | 50 | 420 | 38 | 9 |
| | 85 | 400 | 20 | 4 |
| V | 50 | 640 | 69 | 36 |
| | 85 | 590 | 47 | 17 |
| VI | 50 | 650 | 72 | 48 |
| | 85 | 570 | 42 | 19 |
| VII | 50 | 680 | 66 | 35 |
| | 85 | 540 | 24 | 6 |
| VIII | 50 | 670 | 79 | 55 |
| | 85 | 580 | 76 | 50 |
| IX | 50 | 730 | 96 | 85 |
| | 85 | 760 | 91 | 82 |
| X | 50 | 690 | 81 | 75 |
| | 85 | 680 | 80 | 73 |

EXAMPLE 2

101 g of HYPALON 30 (trade name of E. I. du Pont de Nemours & Co. (Inc.), Wilmington, Del., U.S.A. for a copoly(ethylene/vinylsulphonyl chloride/vinyl chloride) (26.1/6.9/67) were dissolved in a mixture of 575 ml of dichloroethane, 156 ml of methyl ethyl ketone, and 31 ml of ethanol. As dispersing agent for the photoconductive pigments 19.5 ml of a 80% solution in toluene of ALKYDAL V 15 (trade-name for an alkyd resin marketed by Bayer A. G., Leverkusen, W.-Germany) were added to this solution. Then, 447 g of photoconductive zinc oxide (Type A Neige extra pur-Vieille Montagne S. A., Belgium) and 61 g of CADMIUM GELB 45 (a cadmium sulphide selenide pigment manufactured by G. Siegle und Co., G.m.b.H., Stuttgart, Feuerbach, W.-Germany; the pigment grains consist of a crystalline mixed cadmium sulphide selenide (97% of CdS and 3% of CdSe) were added with stirring. The pigment composition was dispersed in a ball-mill for 24 h.

The pigment composition was divided into four equal parts A, B, C and D. One of the parts called part B was mixed with compound 3 of Table 1. Other parts called parts C and D were mixed respectively with $\beta$-mercaptopropionic acid and compound 4 of Table 1. The admixed compounds were used in an amount of $0.34\times10^{-2}$ mole per mole of photoconductive zinc oxide. The coating compositions A, B, C and D, composition A serving as a blank, were coated onto an aluminium foil in a ratio of 33 g of solid matter per sq.m. The coating was dried in a laminar current drier at 30°–40° C.

The dried materials were kept at 20° C. in the dark in a closed cabinet with relative humidity of 80% for 24 h.

After leaving the cabinet the materials A, B, C and D were corona-charged as described in Example 1 and their voltage was measured immediately after charging and 30 s later. The obtained results are listed in Table 3.

TABLE 3

| Material | Charge acceptance in Volt | Charge retention after 30s (expressed in % voltage with resp. to the original value) |
|---|---|---|
| A | 480 | 50 |
| B | 630 | 67 |
| C | 680 | 85 |
| D | 650 | 64 |

EXAMPLE 3

A photoconductive coating composition A was prepared as follows. The following mixture was dispersed in a ball-mill for 24 h:

28 g of DE SOTO E 202 (trade name of De Soto Inc., Des Plaines, Ill., U.S.A.) for a 54% solution in a 50/50 by volume mixture of butyl acetate and toluene of a terpolymer of vinyl acetate/ethyl acrylate/styrene (44/32/24), 72 ml of 1,2-dichloroethane, 14 ml of n-butyl acetate, 54 g of photoconductive zinc oxide MICROX (trade name of Durham Chemicals Ltd., England), 6 g of CADMIUM GELB 45 (trade name), 1% of compound 3 of Table 1 calculated on the total amount of photoconductive pigments.

Compositions B and C were prepared in the same way as composition A with the difference, however, that in the compositions B and C the ZnO/CdS-Se ratio was 80:20 and 70:30 respectively.

The coating compositions A, B and C were doctor blade-coated to an aluminium foil in a ratio of 30 g per sq.m.

The dried coating parts of the materials A, B and C were conditioned at 20° C. and a relative humidity of 10% and other parts at a relative humidity of 80% at 35° C. The conditioning time was 4 days for each sample. Thereupon these material parts were charged with a negative corona (having a voltage on the corona wires of −6000 V with respect to the ground) for 30 s. Immediately after the corona charging was terminated the charge applied to each material part was measured by recording with an electrometer the voltage built up between the recording layer surface and the ground. Then the voltage remaining after 120 s was then measured and expressed in the following Table 4 in terms of percentage of the initial voltage.

TABLE 4

| Material | Relative humidity % R.H. | Charge acceptance expressed in voltage (V) | Charge retention expressed in % with respect to initial voltage (V) after 120 s |
|---|---|---|---|
| A | 10 | 700 | 56 |
| | 80 | 700 | 54 |
| B | 10 | 720 | 60 |
| | 80 | 700 | 60 |
| C | 10 | 720 | 67 |
| | 80 | 700 | 66 |

EXAMPLE 4

A photoconductive test material was prepared as follows. The following mixture was dispersed in a ball-mill for 24 h:

27.8 g of DE SOTO E 202 (trade name of De Soto Inc., Des Plaines, Ill., U.S.A.) for a 54% solution in a 50/50 by volume mixture of butyl acetate and toluene of a terpolymer of vinyl acetate/ethyl acrylate/styrene (44/32/24), 60 g of 1,2-dichloroethane, 8 g of n-butyl acetate, 60 g of photoconductive zinc oxide MICROX (trade name of Durham Chemicals Ltd., England), $0.25 \times 10^{-2}$ mole per mole of zinc oxide of a stabilizing compound as defined hereinafter and selected for determining its influence on the dark-decay.

The blank material which did not include a stabilizing compound was called material A. The comparison material B contained HS—$CH_2$—COOH and the comparison materials C to E contained respectively compounds 1 to 3 of the Table 1 mentioned hereinbefore.

The coating compositions of materials A to E were doctor blade-coated to an aluminium foil in the same ratio, viz. 30 g per sq.m.

After drying strips of the materials A to E were conditioned for 4 days at 20° C. in an atmosphere of a relative humidity of 85%. Thereupon the strips of these materials were charged with a negative corona (having a voltage on the corona wires of −6000 V with respect to the ground) for 30 s. Immediately after the corona charging was terminated the charge applied to each strip was measured by recording with an electrometer the voltage built up between the recording layer surface and the ground. Then the voltage remaining after 120 s was then measured and expressed in the following Table 5 in terms of percentage of the initial voltage.

TABLE 5

| Material | Relative humidity % R.H. | Charge acceptance expressed in voltage (V) | Charge retention expressed in % with resp. to initial voltage (V) after 120 s |
|---|---|---|---|
| A | 85 | 790 | 51 |
| B | 85 | 730 | 54 |
| C | 85 | 700 | 59 |
| D | 85 | 800 | 77 |
| E | 85 | 765 | 66 |

We claim:

1. An electrophotographic recording material comprising a photoconductive layer containing photoconductive zinc oxide particles dispersed in a binder, some or all of which particles are in contact and/or in reacted form with at least one organic compound within the scope of the following general formulae (A), (B) and (C):

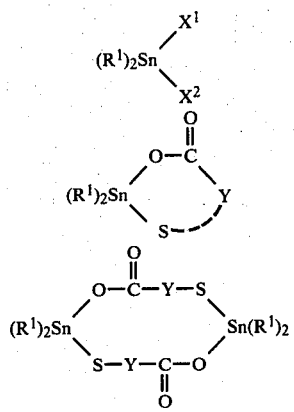

(A)

(B)

(C)

wherein:

$R^1$ represents an alkyl group including an aromatically substituted alkyl group, each of $X^1$ and $X^2$, which may be the same or different, represents a —S—$R^3$ group wherein $R^3$ represents an alkyl group or a substituted alkyl group, and Y represents an alkylene group, the amount of said organic compound present in said layer being sufficient to significantly improve the charge retention of said material in the dark and under conditions of high humidity.

2. A material according to claim 1, wherein $R^1$ is a ($C_1$–$C_4$) alkyl group.

3. A material according to claim 1, wherein the total weight of organic compound present is in the range of 0.05 to 5.0% with respect to the photoconductive zinc oxide.

4. A material according to claim 1, wherein the photoconductive layer contains an admixture of photoconductive zinc oxide with at least one other photoconductive substance.

5. A material according to claim 4, wherein such other photoconductive substance is cadmium sulphide or cadmium sulphide selenide.

6. A material according to claim 1, wherein the total amount of photoconductive substance present in the photoconductive layer equals 3 to 9 parts by weight to 1 part by weight of binder.

7. A material according to claim 1, wherein the photoconductive layer is present on a support having a resistivity smaller than $10^9$ Ohm.cm.

* * * * *